United States Patent [19]

de Mets

[11] 4,419,062

[45] Dec. 6, 1983

[54] CONTINUOUS OPERATION PRESS

[75] Inventor: Albert de Mets, Roeselaare, Belgium

[73] Assignee: de Mets N.V., Tzegem, Kachtem, Belgium

[21] Appl. No.: 321,608

[22] Filed: Nov. 16, 1981

[30] Foreign Application Priority Data

Nov. 14, 1980 [DE] Fed. Rep. of Germany ..... 35065

[51] Int. Cl.[3] ..... B30B 5/06

[52] U.S. Cl. ..... 425/101; 425/371

[58] Field of Search ..... 425/101, 371

[56] References Cited

U.S. PATENT DOCUMENTS 3,521,552 7/1970 Knapp ..... 425/101

*Primary Examiner*—Maurice J. Welsh

*Attorney, Agent, or Firm*—Antonelli, Terry & Wands

[57] ABSTRACT

A continuous operation press for manufacturing and/or coating, veneering, etc., a single layer or multiple layer board web made of wood chips, wood fibers, etc. The press includes a carrying or supporting run of a lower continuously-circulating steel belt and a carrying or supporting run of an upper continuously-circulating steel belt. The pressing of the board web takes place between the upper and lower runs. An underside of the lower circulating belt rests on an abutment or support which is provided with a friction reducing arrangement, with the entire friction reducing arrangement being surrounded by a sealing arrangement.

32 Claims, 3 Drawing Figures

CONTINUOUS OPERATION PRESS

The present invention relates to a continuous operation press preferably for producing and/or collating, veneering, etc., a single-layer or multiple layer board web which is fashioned from a prefabricated material and/or a raw material such as, for example, a lignocellulose-containing and/or cellulose-containing particle such as, for example, wood chips, wood fibers, provided with at least one binder or a mat including such materials. The press includes an upper and lower belt means defining an upper and lower carrying or supporting run between which the board web is conveyed. The upper and lower belts continually circulate at a constant speed, with an underside of a belt facing away from the mat resting, by way of a friction reducing means such as a slide layer lubricated with a liquid lubricant, on an abutment which extends perpendicular to a direction of conveyance of the mat. The slide layer extends over an entire width of a press area of the press and is disposed at the reverse side of the belt.

A press of the aforementioned type is proposed in, for example, Offenlegungsschrift No. 27 05 258, wherein an underside of a metal belt is supported by an apron conveyor which circulates in such a manner that a speed of the conveyor relative to the belt is zero. In this proposed construction, the individual plates of the apron conveyor are constructed in such a manner that they fit tightly together on the underside of the belt and rotate with the belt at the same relative speed. A slide coating means, resting on a fixed abutment, is arranged on an underside of the individual steel plates of the apron conveyor, with the abutment being lubricated with a lubricant. Since the individual plates of the continuously circulating apron conveyor must be guided along certain paths, there are gaps between the individual slide coatings of the respective plates, with these surfaces being smaller than the support faces of the plates which lie against the underside of the metal belt. Additionally, the friction characteristics of the slide coating means is intended to supplement the lubricant supplied to the abutment.

A disadvantage of the above proposed press resides in the fact that the use of an apron conveyor in addition to a continuously circulating metal belt is both expensive and relatively cumbersome.

A further disadvantage of the above proposed press resides in the fact that the provision of the slide coating means on the underside of each individual plate of the apron conveyor involves considerable expenses in terms of both time and cost.

Further serious disadvantages are encountered during an operation of the above-proposed press. More particularly, the plates of the apron conveyor are contiguious with the underside of the metal belt and move therewith, with the slide coating means on the underside of the individual plates resting on the abutment. Despite the lubrication of the abutment, this arrangement causes an upsetting moment resulting in the individual plates tilting slightly. As a result of the slight tilting of the individual plates, the slide coating means does not lie with a uniform flatness on the abutment but rather lies on the abutment only with its forward edge, as viewed in a direction of conveyance thereby leading to greater abrasion between the abutment and the slide coating means and, consequently, resulting in a relatively poor frictional co-efficient. This deterioration of the friction co-efficient means not only that the slightly tilted position of the individual plates of the apron conveyor is preserved but also the position is even stabilized. Furthermore, the support surfaces of the individual plates of the apron conveyor which are in contact with an underside of the metal belt cannot absorb a uniform surface pressure or transmit such pressure to the mat to be pressed since the pressure value rises over the length of the slide coating means in a direction of conveyance.

As a result of the above noted disadvantages which occur during the operation of the proposed press, the board web to be manufactured is of an uneven thickness since the irregular distribution of the surface pressure is not compensated for during a passage of the mat through the press. Moreover, the individual plates of the apron conveyor and the continuously circulating metal belts as well as the mat which is conveyed between the two belts have no relative velocity with respect to one another so that the irregularity in the pressure during the entire pressing process affects the mat at the same point and thus the finished board is correspondingly adversely affected.

A still further disadvantage of the above-proposed press resides in the fact that the limited tolerances which must be observed with regard to the thickness of the board cannot easily be obtained and, additionally, the capacity of the proposed press is limited because of the overturning or tilting moment which is created.

In, for example, Offenlegungsschrift No. 25 11 878, a further press is proposed wherein the belt is guided by a large diameter roller in the press gap and, in areas adjacent to the large diameter roller, that is, in a forward or main press area in which a calibration zone is arranged, an underside of the belt rests directly on a slide foil where a lubricant is supplied and discharged through arrow-shaped grooves in order to reduce the friction between the belt and slide foil. Since this slide foil extends to a point beyond a height of the scattered mat which is to be pressed in the forward press area, a relatively high leakage rate is expected due to the lack of contact pressure from the belt in a direction of the slide foil or coating because the lubricant discharges virtually unimpeded at the lateral edges.

The last mentioned proposed press is actually a prepress and may not readily be used as a finishing press because of the leakage of the lubricant and also because of the considerably higher pressure which must be used at acceptable friction values with a simultaneously high capacity without making use of rollers or similar mechanical supports, that is, with only the slide coating means and the lubricant which discharges through the arrow-shaped grooves.

The aim underlying the present invention essentially resides in providing a press of the aforementioned type which minimizes if not avoids a leakage of a lubricant supplied to a friction reducing means of the press.

In accordance with advantageous features of the present invention, a seal means extending over an entire width of the press area is fixedly disposed in an area of an underside of the belt and, as viewed in a direction of conveyance, is located forwardly of an entrance to the press area.

In accordance with further features of the present invention, a seal means is also provided, as viewed in a direction of conveyance of the board web, at a rear end of the press area with the seal means extending transversely over an entire width of the press area.

Advantageously, according to the present invention, a seal means is also mounted on each lateral side of the press area and, preferably, all of the seal means are interconnected or formed of a single piece and cover the entire press area.

In accordance with the present invention, the seal means include a block formed of an elastic plastic material, with the lip being connected to the block and terminating in a sealing edge.

Advantageously, the lip of the seal means is pressed or urged against the belt by a thrust or counter pressure bearing means. The counter pressure bearing means may be in the form of a plastic strip which is disposed or accommodated in a channel of a retainer.

In accordance with still further features of the present invention, the retainer is provided with passages for receiving the lubricant which discharges laterally at the belt as well as for lubricant which is retained or stopped by the sealing edge of the lip so as to absorb and prevent any leakage of the lubricant.

Preferably, the slide coating means of the present invention is vulcanized onto an abutment and, advantageously, the slide coating means is of a plastic material which is cast onto a perforated plate and cured or is formed of rubber such as silicone rubber or Viton.

The plastic material of the slide coating means of the present invention may, for example, consist of a polytetrafluorethylene, with the perforated plate being disposed on the abutment or secured thereto by, for example, welding, gluing, or the like.

By virtue of the above noted features of the present invention, presently existing continuous operating presses may readily be retrofitted by, for example, securing the abutment with the slide coating means thereon and the seals in connections for the fed and discharge of the lubricant at two base plates thereby providing a modular type retrofitting unit for the presses.

Accordingly, it is an object of the present invention to provide a continuous operation press which avoids, by simple means, shortcomings and disadvantages encountered in the prior art.

Another object of the present invention resides in providing a continuous operation press having a friction reducing means in a press area of the press which is simple in construction and therefore relatively inexpensive to manufacture.

Another object of the present invention resides in providing a continuous operation press which minimizes the friction between the belt of the press and the ajoining portions thereof at least in a press area of the press.

A further object of the present invention resides in providing a friction reducing means for a continuous operating press which may be retrofitted into existing presses.

These and other objects, features, and advantages of the present invention will become more apparent from the following description when taken in connection with the accompanying drawing which shows, for the purposes of illustration only, one embodiment in accordance with the present invention, and wherein.

Figure 1:
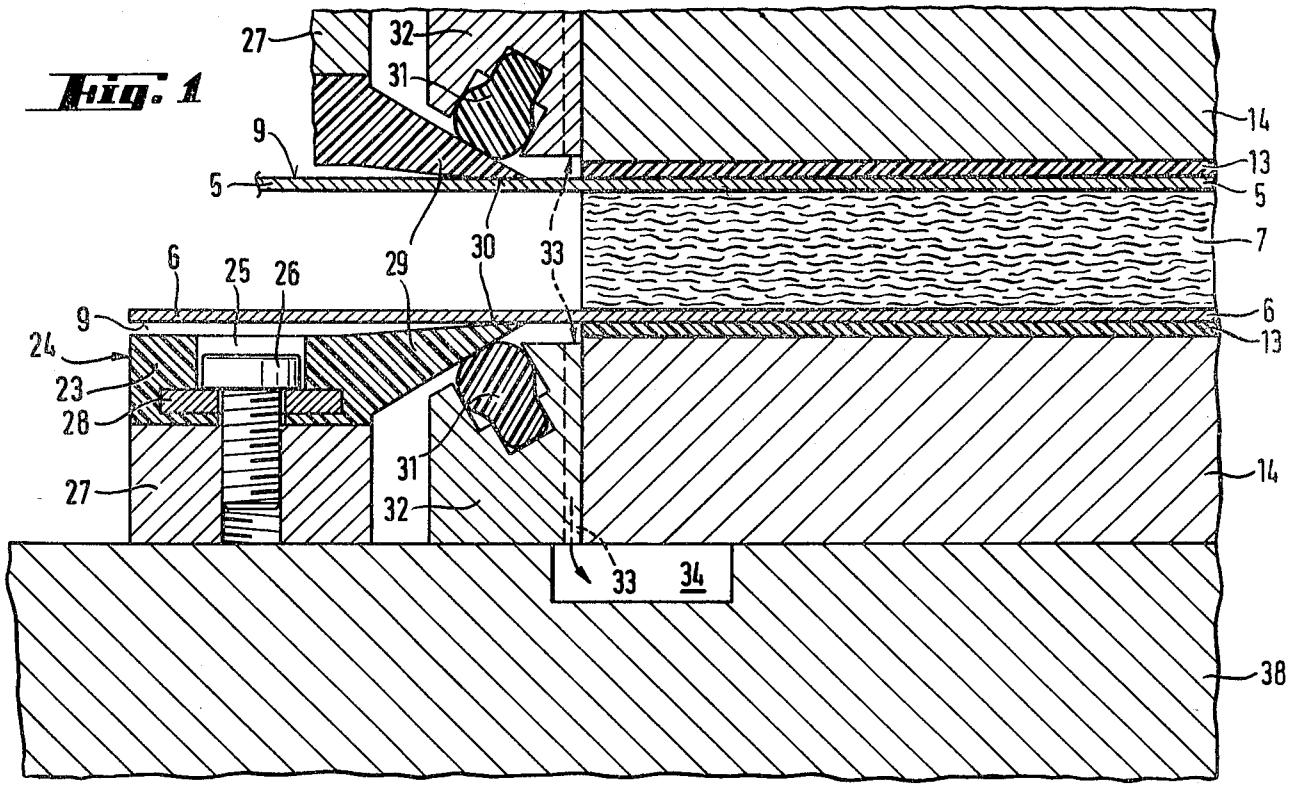
FIG. 1 is a partially schematic cross sectional view, on an enlarged scale, of a press constructed in accordance with the present invention.

Referring now to the drawings wherein like reference numerals are used through the various views to designate like parts and, more particularly, to FIG. 1, according to this figure, a mat 7 is conveyed between an upper continuously circulating belt 5 and a lower continuously circulating belt 6, with the mat 7 being moved in a direction of conveyance 8 (FIG. 2) during a simultaneous prepressing and finish pressing operation. A friction reducing means such as, for example, a slide coating means 13, extending throughout an entire press area of the press, is disposed on an underside 9 of the belts 5, 6 facing away from the mat 7, with the slide coating means 13 being, for example, vulcanized onto an abutment 14 formed of, for example, rubber mounted on a support such as a securing plate 38.

The entire pressing area, approximately rectangular in shape, or the slide coating means 13 is surrounded by a seal 23 which rectangularly encompasses the entire pressing area of slide coating means 13, with the seal 23 being constructed as a single piece. Thus, the seal 23 extend at a forward and rearward end of the press area as well as along both lateral sides. The seal 23 is elastic and formed of, for example, a plastic material. The seal 23 includes a sealing block generally designated by the reference numeral 24 having an opening 25 therein for accommodating a fastener such as, for example, a screw 26 which is threadably secured in a retaining block 27. A head of the screw 26 fits snuggly against a support disk 28 formed, for example, as a washer or a flat iron bar provided with corresponding holes for accommodating the screws 26 so that the overall seal 23 is pressed flat against the retaining block 27.

A lip 29, disposed in a direction facing the press area, extends from the sealing block 24 and terminates in a sealing edge 30 in contact with the underside 9 of the belt 6. The lip 29 is pressed or urged tightly against the underside of the belt 6 by a counterpressure or thrust bearing 31. The bearing 31 may be formed, for example, as a strip of a plastic material and may be arranged in a channel of a retainer 32. The retainer 32 is provided with a lubricant passage generally designated by the reference numeral 33 which leads or extends to a lubricant collecting channel 34.

Figure 2:
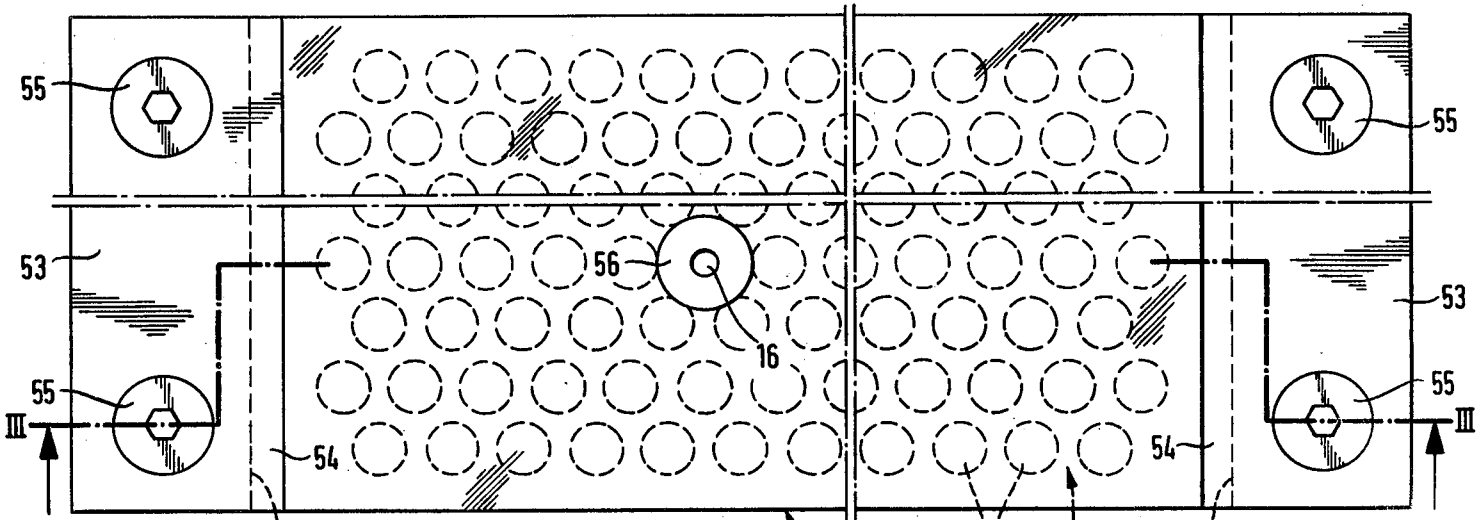
FIG. 2 is a top view of a friction reducing means and associated perforated plate constructed in accordance with the present invention.

As shown most clearly in FIG. 2, the slide coating means 13 is arranged so as to cover the entire rectangular press are a and extend in a direction of conveyance 8 of the mat 7. Preferably, the slide coating means 13 is formed by a plastic material such as, for example, polytetrafluorethylene, poured onto a perforated plate generally designated by the reference numeral 50.

Figure 3:
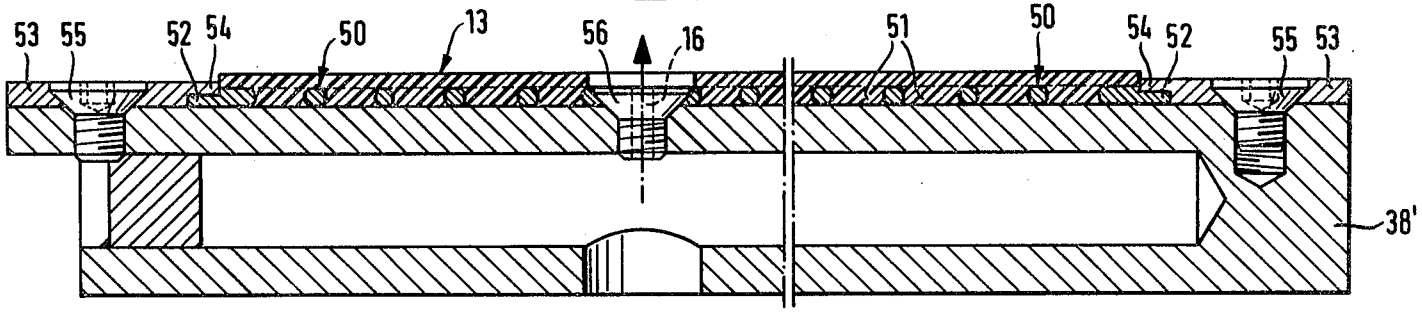
FIG. 3 is a cross sectional view taken along the line III—III in FIG. 2.

As shown most clearly in FIG. 3, the individual holes 51 of the perforated plate 50 are, in a top view countersunk and may also be formed as conical bores.

As also shown in FIG. 3, the perforated plate 50 includes a projecting or overhanging area 52 extending in the direction of conveyance 8, with the projecting or overhanging area 52 being fastened at a securing plate 38' by an overlapping or projecting area 54 of the fastening plate such as, for example, a flat iron bar 53 provided with a recess for accommodating the projecting or overhanging area 52. With such an arrangement, the flat iron bar 53 is disposed at a position which is lower than the underside 9 of the belt 6.

The slide coating means 13 may additionally be secured in a center area thereof by a suitable fastener 56, with the fastener 56 being provided with a longitudinally extending bore 16 therein for forming a lubricant discharge opening.

While I have shown and described only one embodiment in accordance with the present invention, it is understood that the same is not limited thereto but is susceptible of numerous changes and modifications as known to one having ordinary skill in the art and I therefore do not wish to be limited to the details shown and described herein, but intend to cover all such modifications as are encompassed by the scope of the appended claims.

I claim:

1. A continuous-operation press for at least one of producing and treating a board web, the press including an upper and lower belt means defining upper and lower carrying runs between which the board web is carried, the upper and lower belts being adapted to continuously circulate at a constant speed, characterized in that support means extending substantially perpendicular to a conveying direction of the board web is provided and extends over an entire width of a press area of the press, the support means is disposed in proximity to an underside of the lower belt, a friction reducing means is arranged on the support means with the underside of the lower belt resting thereon, means are provided for supplying a lubricant to the friction reducing means, and in that a seal means is fixedly mounted on the press at least in a vicinity of an exit to the press area as viewed in a direction of conveyance of the board web, the seal means extends over an entire width of the press area.

2. A press according to claim 1, characterized in that the board web is formed of at least a single layer of one of a prefabricated material and a raw material composed of at least one of lignocellulose-containing and cellulose-containing particles with at least one binder.

3. A press according to claim 2, characterized in that the material of the board web is composed of at least one of wood chips, wood fibers, and a mat.

4. A press according to one of claims 1 or 3, characterized in that a seal means is fixedly mounted on the press in a vicinity of an entrance of the press area and extends transversely across an entire width of the press area.

5. A press according to claim 4, characterized in that a seal means is mounted along each lateral side of the press area and extends in a direction parallel to the direction of conveyance.

6. A press according to claim 5, characterized in that the seal means at the entrance, exit, and along each of the lateral sides of the press area are formed as a single piece.

7. A press according to claim 6, characterized in that each seal means includes a block portion having a lip thereon terminating in a sealing edge engageable with the underside of the lower belt.

8. A press according to claim 7,characterized in that means are provided for urging the lip means of each of the seal means against the underside of the lower belt.

9. A press according to claim 8, characterized in that a retainer means is provided along the entrance and exit of the press area and along each lateral side thereof, and in that a channel means is provided in the retainer means for accommodating the urging means.

10. A press according to claim 9, characterized in that the urging means is a bearing formed of a strip of plastic material.

11. A press according to claim 10, characterized in that means are provided in the retainer means for receiving lubricant from the belt and lubricant retained by the lip of the seal means.

12. A press according to claim 11, characterized in that the receiving means includes at least one passage means communicating with a lubricant accommodating chamber.

13. A press according to claim 12, characterized in that the friction reducing means includes a coating provided on the support means.

14. A press according to claim 13, characterized in that the coating is vulcanized on the support means.

15. A press according to claim 12, characterized in that the friction reducing means includes a perforated plate mounted on the support means, and a friction reducing material provided on the perforated plate.

16. A press according to claim 15, characterized in that the friction reducing material is cast and cured on the perforated plate.

17. A press according to claim 15, characterized in that the friction reducing material is polytetrafluorethylene, and in that the perforated plate is mounted on the support means by one of a weld and an adhesive.

18. A press according to claim 15, characterized in that the perforated plate includes a projecting portion extending along each lateral side thereof, fastening plate means are provided for overlapping the respective projecting portions of the perforated plate, and fastener means are provided for securing the fastening plate means and perforated plate to the support means.

19. A press according to claim 18, characterized in that an additional fastener means is provided for securing a center area of the perforated plate to the support means, and in that means are provided in the additional fastener means for supplying a lubricant to the friction reducing material.

20. A press according to claim 1, characterized in that the seal means includes a block portion having a lip thereon terminating in a sealing edge engageable with the underside of the lower belt.

21. A press according to claim 20, characterized in that means are provided for urging the lip of the seal means against the underside of the belt.

22. A press according to one of claims 20 or 21, characterized in that the friction reducing means includes a perforated plate mounted on the support means, and a friction reducing material provided on the perforated plate.

23. A press according to one of claims 20 or 21, characterized in that the friction reducing means includes a coating provided on the support means.

24. A press according to claim 20, characterized in that a second seal means is fixedly mounted on the press in a vicinity of an exit from the press area and extends transversely across an entire width of the press area.

25. A press according to claim 24, characterized in that the second seal means includes a block portion having a lip thereon terminating in a sealing edge engageable with an underside of the lower belt.

26. A press according to one of claims 24 or 25, characterized in that the friction reducing means includes a coating provided on the support means.

27. A press according to one of claims 24 or 25, characterized in that the friction reducing means includes a perforated plate mounted on the support means, and a friction reducing material provided on the perforated plate.

28. A press according to claim 20, characterized in that a third and fourth seal means are respectively disposed on lateral sides of the press area.

29. A press according to claim 28, characterized in that the third and fourth seal means each include a block portion having a lip thereon terminating in a sealing edge engageable with the underside of the lower belt.

30. A press according to one of claims 28 or 29, characterized in that the friction reducing means includes a coating provided on the support means.

31. A press according to one of claims 28 or 29, characterized in that the friction reducing means includes a perforated plate mounted on the support means, and a friction reducing material provided on the peforated plate.

32. A press according to claim 28, characterized in that each of the seal means are interconnected so as to form a single piece seal.

* * * * *